US007153447B2

(12) United States Patent
Dobbelstein et al.

(10) Patent No.: US 7,153,447 B2
(45) Date of Patent: Dec. 26, 2006

(54) FORMULATION OF A HIGHLY VISCOUS MINERAL OIL FOR THE PRODUCTION OF FILTERS FOR TOBACCO PRODUCTS

(75) Inventors: Hubert Dobbelstein, Bad Ems (DE); Emini Shefqet, Lahnstein (DE)

(73) Assignee: Shefqet Emini, Dusseldorf (DE)

( * ) Notice: Subject to any disclaimer, the term of this patent is extended or adjusted under 35 U.S.C. 154(b) by 160 days.

(21) Appl. No.: 10/200,611

(22) Filed: Jul. 22, 2002

(65) Prior Publication Data

US 2004/0007687 A1 Jan. 15, 2004

(30) Foreign Application Priority Data

Jul. 11, 2002 (EP) ..... 02015405

(51) Int. Cl.

| | |
|---|---|
| ***D06M 13/02*** | (2006.01) |
| ***D06M 13/00*** | (2006.01) |
| ***D06M 15/227*** | (2006.01) |
| *A24D 3/10* | (2006.01) |
| *A24D 3/06* | (2006.01) |

(52) U.S. Cl. ..... 252/8.86; 252/8.81; 252/8.83

(58) Field of Classification Search ..... 252/8.81, 252/8.83, 8.86

See application file for complete search history.

(56) References Cited

U.S. PATENT DOCUMENTS

| | | | | | |
|---|---|---|---|---|---|
| 2,436,980 | A | * | 3/1948 | Standley et al. | 57/241 |
| 2,461,043 | A | | 2/1949 | Eisen | 57/295 |
| 2,565,403 | A | * | 8/1951 | Sproule et al. | 252/8.81 |
| 2,690,426 | A | * | 9/1954 | Jefferson et al. | 428/375 |
| 2,839,464 | A | * | 6/1958 | Norton et al. | 252/8.85 |
| 2,900,988 | A | * | 8/1959 | Crawford et al. | 131/343 |
| 2,953,837 | A | * | 9/1960 | Crawford et al. | 428/369 |
| 3,050,465 | A | * | 8/1962 | Francis | 508/308 |
| 3,192,159 | A | * | 6/1965 | Francis | 508/276 |
| 3,242,074 | A | * | 3/1966 | Donaldson et al. | 428/395 |
| 3,297,570 | A | * | 1/1967 | White et al. | 252/8.81 |
| 3,306,850 | A | * | 2/1967 | Olsen | 252/8.81 |
| 3,428,560 | A | * | 2/1969 | Olsen | 252/8.81 |
| 3,522,175 | A | * | 7/1970 | Katsumi et al. | 252/8.84 |
| 3,652,419 | A | * | 3/1972 | Karg | 252/8.81 |
| 3,756,253 | A | * | 9/1973 | Honda et al. | 131/343 |
| 3,781,202 | A | * | 12/1973 | Marshall et al. | 252/8.84 |
| 4,330,422 | A | | 5/1982 | Tesch et al. | 134/34 |
| 4,995,884 | A | | 2/1991 | Ross et al. | 8/115.6 |
| 5,232,742 | A | * | 8/1993 | Chakravarti | 427/387 |

FOREIGN PATENT DOCUMENTS

| | | | |
|---|---|---|---|
| DE | 1 212 459 | | 4/1966 |
| GB | 713 749 | | 8/1954 |
| JP | 6-57541 | A * | 3/1994 |
| JP | 06-279790 | A * | 10/1994 |
| JP | 08-12989 | A * | 1/1996 |

OTHER PUBLICATIONS

Table showing Equivalents of Kinematic and Saybolt Universal Viscosity, downloaded from http://pump.netliquiddatakinsayunivisc (no date).*

Table showing Equivalents of various units of viscosity, downloaded from http://kimble-kontes.com/html/Viscosity-254 (no date.*

Derwent Abstract No. 1992-274557, abstract of Korean Patent Specification No. KR9000805B (Feb. 1991).*

Office Journal of the European Communities, "Commission Directive 1999 91/EC", Apr. 12, 1991, pp. 41-55.

* cited by examiner

*Primary Examiner*—Anthony J. Green

(74) *Attorney, Agent, or Firm*—Sutherland Asbill & Brennan LLP

(57) ABSTRACT

The present invention relates to an emulsion for use as a lubricant in the production of threads, containing:

a) 30 to 90 percent by weight of a mineral oil with a viscosity of at least 8.5 $mm^2/s$ at 100° C. and b) 11 to 60 percent by weight of an emulsifier selected from sorbitan monoesters, derivatives of sorbitan monoesters, sorbitan diesters, derivatives of sorbitan diesters, sorbitan triesters, derivatives of sorbitan triesters, polyglyerol esters, derivatives of polyglyerol esters, polyricinoleate, derivatives of polyricinoleate, and mixtures thereof. The threads are used for the production of filters for tobacco products.

9 Claims, No Drawings

FORMULATION OF A HIGHLY VISCOUS MINERAL OIL FOR THE PRODUCTION OF FILTERS FOR TOBACCO PRODUCTS

The present invention relates to a formulation for use as a lubricant in the production of threads. The threads are initially produced in a spinning process, which is preferably the solvent spinning process, and then processed further with the application of the inventive formulation to the surface of the threads as a lubricant. The produced threads are preferably cellulose acetate threads and these threads are used for the production of filters for tobacco products and especially cigarette filters.

Patent specification GB 896,599 describes tobacco filters that can be used in cigarettes, pipes, cigarette-holders and cigar-holders. The filter elements described consist of bundles of continuous man-made filaments, on the surface of which water-insoluble calcium or magnesium salts are present in a fine distribution. These finely distributed particles are fixed on the fibers with oils. Apart from mineral oils, these oils can also be high-boiling liquid esters of native origin, liquid esters of natural fats or liquid high-molecular fatty alcohols.

Patent specification GB 765,962 describes a tobacco filter element consisting of cellulose acetate fibers. In the production of cigarette filters, the cellulose acetate filter material is subjected to manifold processing steps, such as the stretching and crimping of the fibers. In order that the fibers can be subjected to these processing steps, the electrostatic charging of the fibers has to be prevented and a lubricant has to be applied to the surface of the fibers. It has been found that treatment with a lubricant that does not result in any electrical discharge is most suitable. This lubricant contains a mineral oil of a purity that would also make it suitable for the production of pharmaceutical products.

DE 12 12 459 describes a rigid tobacco smoke filter consisting of a bundle of possibly crimped continuous threads and a paper wrapping. The threads consist of a mixture of a polyalphaolefin and a plasticizer-soluble polymer of an organic plasticizer. Not only light, medium and heavy mineral oils can be used as the liquid organic plasticizer, but also liquid high-boiling organic esters or water-insoluble propylene glycols or polybutylene glycols.

U.S. Pat. No. 4,330,422 describes a cleaning composition containing white mineral oil. The emulsion is used for the treatment and cleaning of metal surfaces. The inventive emulsion contains 20–50 percent by weight of a mineral oil with a viscosity of 50–380 Saybolt seconds, measured at 100° F., and 0.5 to 10 percent by weight of an emulsifier. To produce such an emulsion, the use of nonionic emulsifiers has proven to be beneficial. In addition to a multitude of emulsifiers, sorbitan esters and polyglycerides of fatty acids are mentioned inter alia. To achieve a very good cleaning effect, only as much emulsifier should be present in the emulsion as is just necessary to form a stable emulsion. In this case 0.5 to 10 percent by weight of the emulsifier is present in the emulsion, 1 to 5 percent by weight of the emulsifier being preferred. If more emulsifier is present in the emulsion, milky spots or streaks may be left on the cleaned surface after cleaning.

As a rule, the production of filters for tobacco products is preceded by a process wherein a thread, usually containing cellulose acetate, is first produced in a spinning process, which is preferably the solvent spinning process.

In the acetone process, an acetone solution of cellulose acetate and matting agent $TiO_2$ is pressed through shower-head-like nozzles (spinnerets). The holes usually have cross sections of unilateral triangular shape. Below the spinnerets is a heated spinning cabinet. The air sucked through the spinning cabinet is heated and picks up the solvent acetone diffusing out of the formed filament, and almost all of the acetone is recovered. In this process, the solution solidifies, decreasing considerably in volume, to form a filament. If triangular holes are employed, the filaments have a Y-shaped cross section. When a thread composed of several filaments leaves the spinning cabinet, the filaments are densely packed in the thread, but without sticking together. At the outlet of the spinning cabinet, the thread typically contains a residual share of about 1 to 6 percent by weight of acetone. Here the thread is provided with a preparation (finish) which mainly serves as lubricant for the subsequent processing steps. This treatment is effected with an oiler or an applicator roller. In the following steps, the content of acetone in the threads is first reduced further, several threads are brought together to form a tow and the tow is subjected to a crimping process with the aid of a crimping machine, which preferably works on the stuffer box principle. To produce filters for tobacco products, this tow is guided through a conical machine part and thus compressed to its final thickness, i.e. the thickness of the filter being produced. Before entering this conical machine part, a composition containing glycerol triacetate is applied to the filter tow. This further treatment results in the fixing of the filter in the desired shape and thickness by curing after leaving the compressing part.

When the threads are brought together to form a tow and when the tow is compressed to its final thickness, the formulation applied after the drying of the threads serves as a lubricant. It ensures among other things that the friction arising during the subsequent processing steps does not exceed a value that would result in the tearing or undesired warming of the threads or tow. Both would cause unwanted wastage. The lubricant also permits higher machine speeds. The formulation must withstand the high shear forces arising during this process without loss of effect.

This lubricant usually consists of an emulsion produced from a mixture of low-viscosity mineral oil and emulsifier. The emulsion may also contain other components.

After the production of the filters and the corresponding tobacco products containing these filters, the mineral oils remain on the threads.

When, for instance, a cigarette containing such a filter is smoked, part of the mineral oil situated on the filter can be inhaled by the smoker. In the mid-nineties Baldwin et al. (M. K. Baldwin et al: "Feeding studies in rats with mineral hydrocarbon food grade white mineral oils", Toxicol. Pathol. 20, 426 (1992)) and Smith et al. (J. H. Smith et al.: "Ninety-day feeding study in Fischer 344-rats of highly refined petroleum-derived food-grade white oils and waxes", Toxicol. Pathol. 24, 214 (1996)) conducted 90-day feeding studies with Fischer 344-rats and identified the following pathological features: Increase in weight and quantity of mineral oil in the liver, increase in the liver enzymes in the serum and increase in weight of the lymph nodes. These effects are significantly more pronounced with low-viscosity mineral oils than with medium- and high-viscosity mineral oils. According to the Scientific Committee for Food of the European Commission, highly viscous mineral oils are distinguished by their viscosity greater than 8.5 $mm^2/s$ at 100° C. or greater than 70 $mm^2/s$ at 40° C. In the EU (Directive 1999/91/EC of 23 Nov. 1999 amending Directive 90/128/EEC "relating to plastic materials and articles intended to come into contact with foodstuff", OJ 310/41 (Apr. 12, 1999)), the use of low-viscosity mineral oils for products with indirect food contact will no longer be permitted after 2002. Attempts to incorporate highly viscous mineral oils in a formulation conforming to the technical requirements of the production of filter materials have so far failed. The emulsifiers used for the emulsification of low-viscosity mineral oils do not yield a stable and processable formulation when highly viscous mineral oils are used. The situation is exacerbated by the fact that emulsifiers have to meet high standards in terms of food safety and possible changes in the flavor of filter cigarettes.

The object of the present invention is to provide a stable and storable emulsion that contains highly viscous mineral oils with a viscosity of at least 8.5 $mm^2/s$ at 100° C. To this end it is necessary to find emulsifiers for the production of a processable formulation. The formulation will then replace the employed formulations containing low-viscosity mineral oils.

The object of the present invention is achieved by a formulation for use as preparation in the production of threads, containing a) 30–90 percent by weight of a mineral oil with a viscosity of at least 8.5 $mm^2/s$ at 100° C. and b) 11–60 percent by weight of an emulsifier selected from sorbitan monoesters, derivatives of sorbitan monoesters, sorbitan diesters, derivatives of sorbitan diesters, sorbitan triesters, derivatives of sorbitan triesters, polyglyerol esters, derivatives of polyglyerol esters, polyricinoleate, derivatives of polyricinoleate, and mixtures thereof.

Contrary to expectation, it has been found that such formulations have comparable and in some cases even better storage and processing stability. The stability of a formulation, which can take the form of an emulsion, can be determined with reference to the turbidity of the formulation. As a fundamental principle, a higher turbidity indicates a lower stability. The processing stability of the formulation can be checked by examining the turbidity of the formulation during processing. No or only slight turbidity is particularly advantageous whereas insufficient formulation stability can be concluded from a strong increase in turbidity. A formulation's storage stability can be checked by examining the turbidity after, for instance, five days' storage at 23° C. If an increase in turbidity is undetectable or only slight after such a storage period, the storage stability of the formulation can be considered very good, whereas an increase in turbidity or the possible segregation of the phases can be characterized as poor storage stability.

The viscosity of the inventive highly viscous mineral oil is at least 8.5 $mm^2/s$ at 100° C., measured in accordance with ASTM D 445. The mineral oil employed preferably has a viscosity of 8.5 to 1000, especially preferably 8.5 to 20 and very especially preferably 8.5 to 11 $mm^2/s$.

The share of hydrocarbons with fewer than 25 carbon atoms in the highly viscous mineral oil is preferably not greater than 5 percent by weight. The mean molecular weight of the highly viscous mineral oil should not be less than 480 g/mol.

The emulsifiers employed according to the invention are selected from sorbitan monoesters, derivatives of sorbitan monoesters, sorbitan diesters, derivatives of sorbitan diesters, sorbitan triesters, derivatives of sorbitan triesters, polyglycerol esters, derivatives of polyglycerol esters, and mixtures thereof. The esters can preferably be esters with fatty acids. Any fatty acid can be used as the fatty acid, e.g. stearic acid, oleic acid, lauric acid and ricinoleic acid ([R-(Z)]-12-hydroxy-9-octadecenoic acid). Alternatively, the fatty acids employed can be derived from maize, cotton oil, palm oil, groundnut oil, sesame oil, soy oil, safflower oil, castor oil or other oils of native origin. The fatty acids can be hydrogenated or non-hydrogenated and condensed or non-condensed.

The sorbitan triester is preferably selected from the group of sorbitan triesters with fatty acids containing 10–25 carbon atoms, ethoxylated sorbitan triesters with fatty acids containing 10–25 carbon atoms and 5–30 mol ethylene oxide units per mol of sorbitan triester, and mixtures thereof.

In a particularly preferred fashion, the sorbitan triester can be selected from the group of sorbitan tristearate, ethoxylated sorbitan tristearate with 5–30 mol ethylene oxide units per mol of sorbitan tristearate, sorbitan trioleate, ethoxylated sorbitan trioleate with 5–30 mol ethylene oxide units per mol of sorbitan trioleate, sorbitan trilaurate, ethoxylated sorbitan trilaurate with 5–30 mol ethylene oxide units per mol of sorbitan trilaurate, and mixtures thereof.

If a polyglycerol ester is employed as the emulsifier, the share of polyglycerol ester can be composed of at least 75 percent di-, tri and tetraglycerol esters. The polyglycerol ester is preferably formed from the group of polyglycerol esters with fatty acids containing 10–25 carbon atoms, derivatives of polyglycerol acids with fatty acids containing 10–25 carbon atoms, polyglycerol polyricinoleate, derivatives of polyglycerol polyricinoleate, and mixtures thereof.

In a preferred embodiment, the formulation contains as an emulsifier a) sorbitan tristearate or ethoxylated sorbitan tristearate with 5–30 mol ethylene oxide units per mol of sorbitan tristearate, b) polyglycerol polyricinoleate and c) sorbitan monolaurate and d) ethoxylated sorbitan monolaurate with 5–30 mol ethylene oxide units per mol of sorbitan monolaurate, and e) sorbitan monooleate.

In another embodiment, if the emulsifier is a mixture of at least two emulsifiers, the mixture of emulsifiers contains, in relation to the weight of the formulation, 1 to 15 percent by weight of ethoxylated sorbitan tristearate with 5–30 mol ethylene oxide units per mol of sorbitan tristearate and/or, in relation to the weight of the formulation, 1 to 15 percent by weight of polyglycerol polyricinoleate and/or polyricinoleate.

If the emulsifier is a mixture of at least two emulsifiers, the mixture of emulsifiers also preferably contains, in relation to the weight of the formulation, 1 to 15 percent by weight of ethoxylated sorbitan monolaurate with 5–30 mol ethylene oxide units per mol of sorbitan monolaurate and/or, in relation to the weight of the formulation, 1 to 15 percent by weight of sorbitan monooleate with 5–30 mol ethylene oxide units per mol of sorbitan monooleate.

The formulation according to the invention preferably contains 30–80 percent by weight of the mineral oil, more preferably 40–80 percent by weight, especially preferably 45–75 percent by weight and very especially preferably 55–72 percent by weight of the mineral oil.

The formulation preferably contains 15–60 percent by weight of the emulsifier, more preferably 20–60 percent by weight and especially preferably 25–55 percent by weight of the emulsifier.

The formulation according to the invention can be a water-in-oil or an oil-in-water emulsion or the formulation forms in water a water-in-oil emulsion or an oil-in-water emulsion. After the spinning process, the inventive formulation is applied in emulsion form to the surface of the threads that are processed into filters for tobacco products. During this processing, the mineral oil remains on the surface of the threads or tow. The threads employed preferably contain cellulose acetate that contains an average of 1.5 to 3 acetate groups per cellulose unit.

The designation "threads" under the terms of this invention also includes fibers that can be produced according to the process described here.

From these fibers, filters for tobacco products can be produced. The filters are preferably cigarette filters. In all work steps, the applied emulsion remains on the fibers and thus on the tow. This means that a small proportion of the emulsion remains in the filters for tobacco products and in the tobacco products themselves.

The emulsion according to the invention will be explained with reference to the following examples, but without being limited to these examples.

EXAMPLES

TABLE 1

| Components | Formulation 1 [percent by weight] | Formulation 2 [percent by weight] |
|---|---|---|
| Mineral oil Primol ® 352[1] | 64.50 | 60.00 |
| Sorbitan monolaurate + 20 EO[2] | 12.80 | 11.60 |
| Sorbitan monolaurate | 8.20 | 13.00 |
| Sorbitan tristearate + 20 EO[2] | — | 4.40 |
| Polyglycerol polyricinoleate | 3.10 | 3.00 |
| Sorbitan monooleate | 5.77 | — |
| Water | Remainder | Remainder |

[1]Primol ® 352 is a highly viscous mineral oil from ESSO AG Viscosity according to ASTM D 445: 71 $mm^2/s$ at 40° C., 9.0 $mm^2/s$ at 100° C.
[2]+20 EO means 20 mol ethylene oxide units per mol of ester.

Formulations 1 and 2 in Table 1 both contain the inventive combination of a mineral oil with a viscosity of at least 8.5 $mm^2/s$ at 100° C. and the inventive emulsifier. The emulsions can be produced with standard methods.

To produce formulation 1, Primol 352 is supplied at room temperature and the raw materials are added with continuous stirring in the following order: Sorbitan monolaurate, sorbitan monolaurate +20 EO, sorbitan monooleate, polyglyerol polyricin oleate and water. Formulation 1 is stirred for a further 30 minutes.

To produce formulation 2, Primol 352 heated to 50° C. is supplied in a stirrer. With continuous stirring at 50° C., the other raw materials are added in the following order: Sorbitan monolaurate, sorbitan monolaurate +20 EO, sorbitan tristearate +20 EO, polyglyerol polyricinoleate and water. After 30 minutes' stirring at 50° C., the formulation is allowed to cool to room temperature and stirring is resumed at this temperature for a further 30 minutes.

Both formulations are used for the production of cellulose acetate threads in the solvent spinning process. It has been found that the formulations employed according to the invention have no negative effect during the production of the threads. Formulation 1 and formulation 2 show storage stability at 23° C. and for five days, which is comparable to that of conventionally used formulations, and, during the processing of the threads into filters, no increase in the turbidity of the emulsion was observed due to the shearing forces arising. The behavior of both formulations is comparable to that of conventionally employed formulations.

The invention claimed is:

1. A formulation for use as a lubricant in the production of threads, containing:

a) 30 to 90 percent by weight of a mineral oil with a viscosity of at least 8.5 $mm^2/s$ at 100° C., and b) 11 to 60 percent by weight of an emulsifier selected from the group consisting of sorbitan triester, polyglycerol ester, and mixtures thereof wherein said sorbitan triester is selected from the group consisting of sorbitan triesters with fatty acids containing 10–25 carbon atoms, ethoxylated sorbitan triesters with fatty acids containing 10–25 carbon atoms and 5–30 mol ethylene oxide units per mol of sorbitan triester, and mixtures thereof, and wherein the polyglycerol ester is selected from the group consisting of polyglycerol esters with fatty acids containing 10–25 carbon atoms, polyglycerol polyricinoleate, derivatives of polyglycerol polyricinoleate, and mixtures thereof.

2. The formulation according to claim 1, wherein the sorbitan triester is selected from the group consisting of sorbitan tristearate, ethoxylated sorbitan tristearate with 5–30 mol ethylene oxide units per mol of sorbitan tristearate, sorbitan trioleate, ethoxylated sorbitan trioleate with 5–30 mol ethylene oxide units per mol of sorbitan trioleate, sorbitan trilaurate, ethoxylated sorbitan trilaurate with 5–30 mol ethylene oxide units per mol of sorbitan trilaurate, and mixtures thereof.

3. The formulation according to claim 1, wherein said formulation contains 30 to 80 percent by weight of the mineral oil.

4. The formulation according to claim 1, wherein said formulation contains 15 to 60 percent by weight of the emulsifier.

5. The formulation according to claim 1, wherein the emulsifier is a mixture of at least two emulsifiers and the mixture of emulsifiers contains, in relation to the weight of the formulation, 1 to 15 percent by weight of ethoxylated sorbitan tristearate with 5–30 mol ethylene oxide units per mol of sorbitan tristearate and/or, in relation to the weight of the formulation, 1 to 15 percent by weight of polyglycerol polyricinoleate and/or polyricinoleate.

6. The formulation according to claim 1, wherein the mineral oil has a viscosity of 8.5 to 1000 $mm^2/s$ at 100° C.

7. The formulation according to claim 1, wherein the formulation is a water-in-oil or an oil-in-water emulsion.

8. A formulation for use as a lubricant in the production of threads, containing:

a) 30 to 90 percent by weight of a mineral oil with a viscosity of at least 8.5 $mm^2/s$ at 100° C., and b) 11 to 60 percent by weight of an emulsifier comprising:

i) sorbitan tristearate or ethoxylated sorbitan tristearate with 5–30 mol ethylene oxide units per mol of sorbitan tristearate, (ii) polyglycerol polyricinoleate, (iii) sorbitan monolaurate, (iv) ethoxylated sorbitan monolaurate with 5 to 30 mol ethylene oxide units per mol of sorbitan monolaurate, and (v) sorbitan monooleate.

9. A formulation for use as a lubricant in the production of threads, containing:

a) 30 to 90 percent by weight of a mineral oil with a viscosity of at least 8.5 $mm^2/s$ at 100° C., and b) 11 to 60 percent by weight of an emulsifier wherein the emulsifier is a mixture of at least two emulsifiers and the mixture of emulsifiers contains, in relation to the weight of the formulation, 1 to 15 percent by weight of ethoxylated sorbitan monolaurate with 5–30 mol ethylene oxide units per mol of sorbitan monolaurate and/or, in relation to the weight of the formulation, 1 to 15 percent by weight of sorbitan monooleate with 5–30 mol ethylene oxide units per mol of sorbitan monooleate.

* * * * *